US008876613B2

(12) United States Patent
Florea

(10) Patent No.: US 8,876,613 B2
(45) Date of Patent: Nov. 4, 2014

(54) WIRELESS SCORING SYSTEM FOR COMPETITIVE SWORDPLAY GAME WITH NONMETALLIC SWORDS

(71) Applicant: Gheorghe Florea, Richmond Hill (CA)
(72) Inventor: Gheorghe Florea, Richmond Hill (CA)
(73) Assignee: Gheorghe Florea, Richmond Hill (CA)

( * ) Notice: Subject to any disclaimer, the term of this patent is extended or adjusted under 35 U.S.C. 154(b) by 47 days.

(21) Appl. No.: 13/651,370

(22) Filed: Oct. 12, 2012

(65) Prior Publication Data

US 2013/0281217 A1 Oct. 24, 2013

Related U.S. Application Data

(60) Provisional application No. 61/563,024, filed on Nov. 22, 2011.

(51) Int. Cl.

| | |
|---|---|
| ***A63B 67/00*** | (2006.01) |
| ***A63B 69/02*** | (2006.01) |
| ***A63B 71/06*** | (2006.01) |
| ***A63B 24/00*** | (2006.01) |
| *A63B 71/10* | (2006.01) |
| *A63B 71/12* | (2006.01) |

(52) U.S. Cl.

CPC ..... *A63B 69/02* (2013.01); *A63B 71/0669* (2013.01); *A63B 24/0084* (2013.01); *A63B 2071/105* (2013.01); *A63B 2071/1208* (2013.01); *A63B 2207/02* (2013.01); *A63B 2220/801* (2013.01); *A63B 2225/50* (2013.01)

USPC ..... 463/47.1; 700/92

(58) Field of Classification Search

CPC .... A63B 69/02; A63B 2225/50; A63B 71/06; A63B 71/0669; F41B 13/02

USPC ..... 463/47.1; 273/454, 555; 482/12; 700/91–93

See application file for complete search history.

(56) References Cited

U.S. PATENT DOCUMENTS

| | | | | | |
|---|---|---|---|---|---|
| 2,868,542 | A | * | 1/1959 | Mieg | 463/47.1 |
| 2,916,287 | A | * | 12/1959 | Davey | 463/47.1 |
| 2,998,974 | A | * | 9/1961 | Stafford | 463/47.1 |
| 3,920,242 | A | * | 11/1975 | Reith et al. | 463/47.1 |
| 4,030,731 | A | * | 6/1977 | Delcayre | 463/47.1 |
| 4,099,714 | A | * | 7/1978 | Willis | 463/47.1 |
| 4,761,005 | A | * | 8/1988 | French et al. | 273/454 |
| 5,184,831 | A | * | 2/1993 | Garner | 273/455 |
| 5,570,881 | A | * | 11/1996 | Lau | 463/47.1 |
| 5,802,607 | A | * | 9/1998 | Triplette | 2/1 |
| 5,836,853 | A | * | 11/1998 | Marciano | 482/12 |

(Continued)

FOREIGN PATENT DOCUMENTS

| | | | | |
|---|---|---|---|---|
| GB | 2458437 B | * | 5/2012 | |
| WO | WO 2010084220 A1 | * | 7/2010 | |

*Primary Examiner* — Milap Shah

(57) ABSTRACT

A wireless scoring system for a competitive swordplay game is provided, which uses nonmetallic swords with electric touch sensors on blades.

Each player carries a mobile touch detector apparatus which transmits wirelessly to scoreboard controller, data packets which indicate fencing touches uniquely identifiable for each player.

Scoreboard is controlled by radio remote apparatus provided with buttons labeled "GO" and "STOP", which when pressed trigger emission of lights of predefined colors by wrist collar, blades of swords and scoreboard.

The rules for scoring are programmed in scoreboard controller apparatus which takes decisions to assign the scoring points throughout the swordplay bout. The player who wins a scoring point is indicated by the color of light emitted by blade of sword of the winner. The rules for scoring include a priority-based scoring method to decide the winner of scoring point when both players execute fencing touches simultaneously.

39 Claims, 11 Drawing Sheets

(56) References Cited

U.S. PATENT DOCUMENTS

| | | | | |
|---|---|---|---|---|
| 6,575,837 | B1 * | 6/2003 | Weske et al. | 463/47.1 |
| 6,612,968 | B1 * | 9/2003 | Alvaro | 482/12 |
| 6,700,051 | B2 * | 3/2004 | Aldridge | 84/733 |
| 6,743,151 | B2 * | 6/2004 | Riggs et al. | 482/12 |
| 8,021,281 | B2 * | 9/2011 | Forsell et al. | 482/84 |
| 8,348,770 | B2 * | 1/2013 | Hart | 463/47.1 |
| 2001/0051542 | A1 * | 12/2001 | Dowdy et al. | 463/47.2 |
| 2002/0032101 | A1 * | 3/2002 | Riggs et al. | 482/1 |
| 2006/0100022 | A1 * | 5/2006 | Linsay | 463/47.1 |
| 2008/0084281 | A1 * | 4/2008 | Huang | 340/323 R |
| 2011/0159939 | A1 * | 6/2011 | Lin et al. | 463/8 |
| 2011/0251802 | A1 * | 10/2011 | Song | 702/41 |
| 2012/0010002 | A1 * | 1/2012 | Hart | 463/47.1 |
| 2012/0028721 | A1 * | 2/2012 | Johnson et al. | 463/47.1 |

* cited by examiner

WIRELESS SCORING SYSTEM FOR COMPETITIVE SWORDPLAY GAME WITH NONMETALLIC SWORDS

CROSS REFERENCE TO RELATED APPLICATIONS

This application claims the benefit under 35 U.S.C. 119(e) of U.S. Provisional Patent Application No. 61/563,024, filled Nov. 22, 2011, the disclosure of which is incorporated by reference herein.

FIELD OF THE INVENTION

The present invention is generally directed to gaming devices and methods of their use. More particularly, the invention is directed to a fencing scoring system and methods of using.

BACKGROUND OF THE INVENTION

The weapons used in fencing sport, have blades made of steel, which in most of the cases generate physical pain during fencing touches, and represent a safety risk. It would be advantageous to eliminate the metal weapons from fencing sport, but in the same time to keep the capability of electrical detection of touches. Games with swords made of foam have been proposed for fencing, but none have the capability of the current invention which delivers precise electronic scoring system with wireless transmission of fencing touches, which makes it suitable for score-based competitions.

The rules for scoring in traditional fencing are complex, and at least one year of competitive experience is needed in order to understand how scoring rules are applied by the referees. One of the objects of this invention is to provide a scoring board apparatus which has the scoring rules incorporated in a micro-controller, which makes the fencing scoring rules simple, and easy to understand in the first day of training.

In traditional fencing, the start and the stop of fencing rounds are done based on the verbal commands from the referee. This creates confusion if the referee makes calls to stop the fencing round right in the middle of a pending fencing action, and some scoring points are invalidated because it is not clear if the fencing touch occurred before or after the referee's call. The current invention offers the solution to control the scoring apparatus with a radio remote apparatus, which enables or disables instantly the part of the electrical circuit which validates the fencing touches in order to score points.

Another object of this invention is to make the start and stop commands sent by the radio remote apparatus visible such that the players can see when the buttons are operated on the radio remote apparatus. This feature is supported by current invention by adding a wrist collar apparatus, which has incorporated lighting devices to emit light of predefined colors when the radio remote apparatus is operated.

The current fencing scoring devices indicate the winner of each scoring point by light signals on the scoring board. But during a fencing round, the two players could move far from the scoring board, so they are not able to see whether a fencing action succeeded to create a valid scoring point. The current invention offers the solution to install lighting devices on the blades of the fencing weapon, allowing this way to introduce light signaling by emitting predefined colors of light when one of the players wins a scoring point. The same lighting devices installed on the blades of the fencing weapon, are used by the current invention, to emit lighting signals when the radio remote apparatus is operated either to start or end the fencing rounds.

Wireless scoring systems have been proposed for sport fencing in the past, but none brings into play weapons made of foam, rubber or plastic, which have the capability to detect fencing touches employing electrical sensors on all sides of the blade.

The Linsay U.S. Pat No. U.S.20060100022 describes a wireless scoring system for fencing with weapons which have metallic blades The Aldridge U.S. Pat. No. 6,700,051 describes a system for scoring contact sports, and in particular karate. Fencing and other contact sports are mentioned but not described with any particularity.

The Alvaro U.S. Pat. No. 6,612,968 shows a fencing weapon made of plastic having a switch at the top of the weapon, thus fencing touches are possible only with the tip of the weapon.

The Delcayre U.S. Pat. No. 4,030,731 describes a scoring system for fencing which uses metallic weapons.

BRIEF SUMMARY OF THE INVENTION

It is an object of this invention to provide a wireless scoring system for a competitive swordplay game, which uses nonmetallic swords with electric touch sensors on the blades.

Each player carries a mobile touch detector apparatus which transmits wirelessly to scoreboard controller apparatus, data packets which indicate fencing touches uniquely identifiable for each player.

The scoreboard is controlled by radio remote apparatus provided with two buttons, one labeled "GO" and one labeled "STOP". When buttons are pressed on the radio remote apparatus, lights of predefined colors are emitted by a wrist collar apparatus, and by electric lighting devices incorporated in the blades of the swords.

The rules for scoring are programmed in scoreboard controller apparatus which takes decisions to assign the scoring points throughout the swordplay bout.

The player who wins a scoring point is indicated by the color of light emitted by the blade of the sword of the winner.

The rules for scoring include a priority-based scoring method to decide the winner of the scoring point when both players execute fencing touches simultaneously.

In other embodiments the priority-based scoring method can be simplified by reducing the number of steps in the method of assigning the priority.

DETAILED DESCRIPTION OF THE INVENTION

As used in this application and in the claims, the singular forms "a," "an," and "the" include the plural forms unless the context clearly dictates otherwise. Additionally, the term "includes" means "comprises."

In the current description of the invention and in the claims, the term "competitive" refers to a system suitable for score-based competitions.

Figure 1:
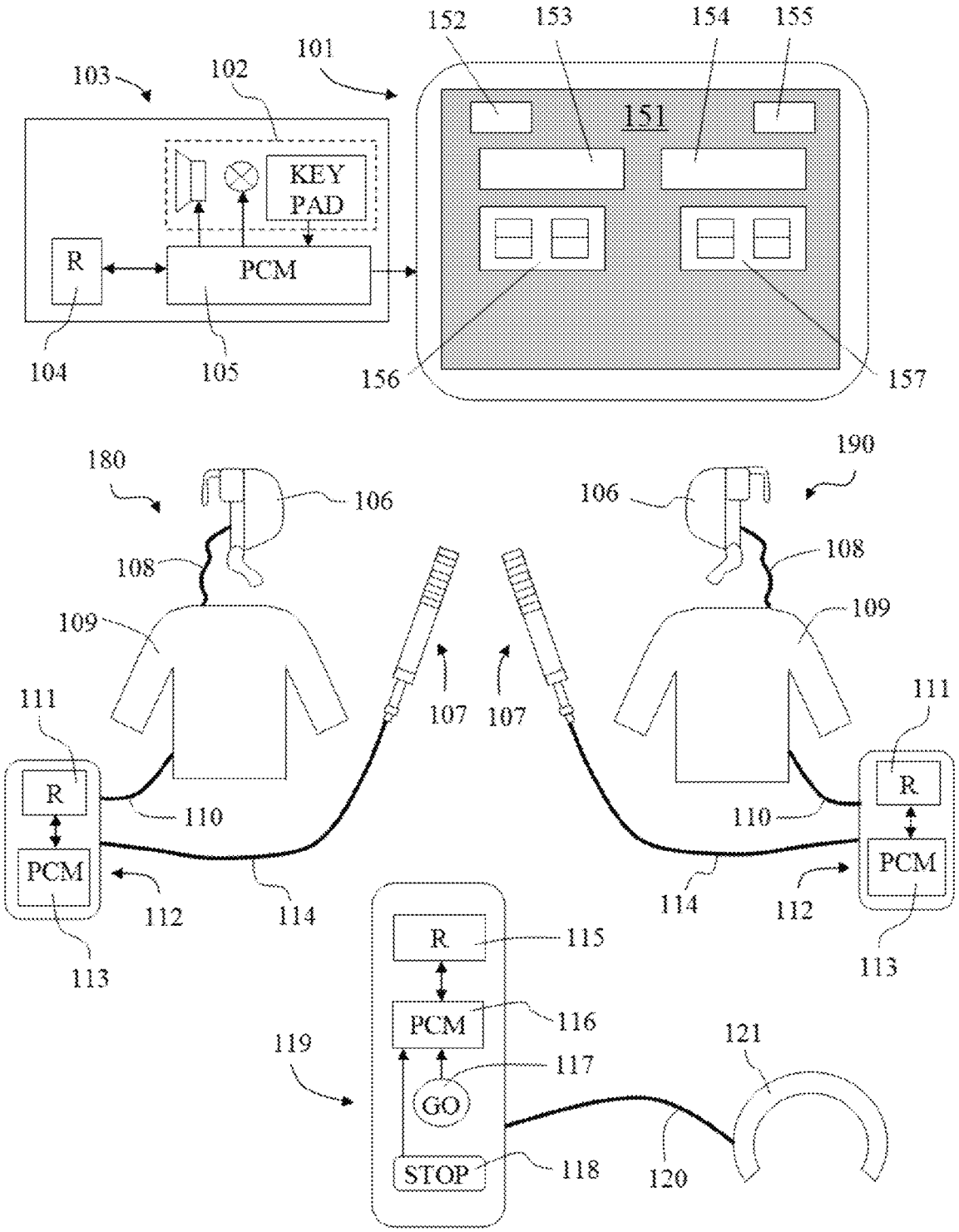
FIG. 1 is a perspective view of the wireless scoring system for competitive swordplay game with nonmetallic swords, according to the invention.

FIG. 1 is a perspective view of the wireless scoring system for a competitive swordplay game with nonmetallic swords, according to the invention. The two players 180 and 190 are represented in FIG. 1 by their fencing jackets and masks.

According to the invention the wireless scoring system for the competitive swordplay game, comprising:

a scoreboard display apparatus 101;

a scoreboard controller apparatus 103 connected to a scoreboard display apparatus 101;

a radio remote control apparatus 119;

a mobile touch detector apparatus 112 adapted to be worn by each player;

a sword 107 worn by each player during the fencing bout;

a jacket 109 worn by each player;

and a mask 106 worn by each player.

In another embodiment, during the swordplay game, each of the players 180 and 190 can use two swords 107, thus, holding one sword 107 in each hand.

In the preferred embodiment, the scoreboard controller apparatus 103 includes peripherals devices 102, comprising:

a plurality of known electrical lighting devices;

a known audible signaling device;

and a known keypad.

The following equipment is used in the preferred embodiment of the invention:

the scoreboard display apparatus 101 is a known computer monitor;

the jacket 109 is the one currently in use in the traditional fencing sport for saber competitions, and is made with electrically conductive threads;

and the mask 106 is the one currently in use in the traditional fencing sport for saber competitions, and it has the external surface electrically conductive.

It is an object of this invention to provide a wireless electric system for a swordplay game, thus as shown in FIG. 1:

there are no electrical wires connected between the players 180 and 190;

and there are no electrical wires connected between the scoreboard controller 103 and any of the players 180 and 190.

According to the invention, the equipment carried by each player during the swordplay bout, is connected as follows:

the jacket 109 is electrically connected with the mask 106 through the electrical wire 108;

the mobile touch detector apparatus 112 is electrically connected with the jacket 109, through the electrical wire 110;

and the mobile touch detector apparatus 112 is electrically connected with the sword 107 through the electrical cable 114.

As shown in FIG. 1, according to the invention each of the apparatuses 103, 112, and 119, includes:

a known radio module 104, 111, and 115, respectively;

and a known Programmable Controller Module (PCM) 105, 113, and 116, respectively.

All the radio modules 104, 111, and 115 are set on the same frequency channel. The PCM 105, 113, and 116 have the capability to execute preloaded software programs and hardware state machines.

As shown in FIG. 1, each of the PCM 105, 113, and 116 is electrically connected with a radio 104, 111, and 115, respectively.

Furthermore, according to the invention, the PCM 105, 113, and 116, are programmed to communicate between each other by transmitting and receiving data packets thorough the radios 104, 111, and 115, respectively.

In FIG. 1 the scoreboard display apparatus 101 displays the image 151, which in the preferred embodiment the image 151 comprising:

the sign 152 to state whether the electric equipment carried by the player 180, is either functional or defective;

the sign 155 to state whether the electric equipment carried by the player 190, is either functional or defective;

the sign 153 to indicate when player 180 wins a scoring point;

the sign 154 to indicate when player 190 wins a scoring point;

the score 156 of player 180;

and the score 157 of player 190.

According to the invention, in FIG. 1 is illustrated the radio remote control apparatus 119, comprising:

a push-button 117 labeled "GO";

a push-button 118 labeled "STOP";

and a wrist collar apparatus 121 which is controlled by PCM 116, through the electrical cable 120.

According to the invention the wrist collar apparatus 121 is an electrical lighting device, which sends luminous information to the players by emitting light of predefined colors when either the "GO" button 117 or the "STOP" button 118, are pressed.

In the current description of the invention and in the claims, the term "nonmetallic sword" refers to an instrument shaped as a sword, and assembled from components which are made of nonmetallic materials, such as foam, plastic, rubber, and fiberglass. Metallic components, such as electrical wires and electrical touch sensors, are used in the structure of the said nonmetallic sword, for the purpose of adding electrical features compatible with an electric circuit required for detecting scoring points, in order to add scoring capability to the swordplay game.

Figure 2:
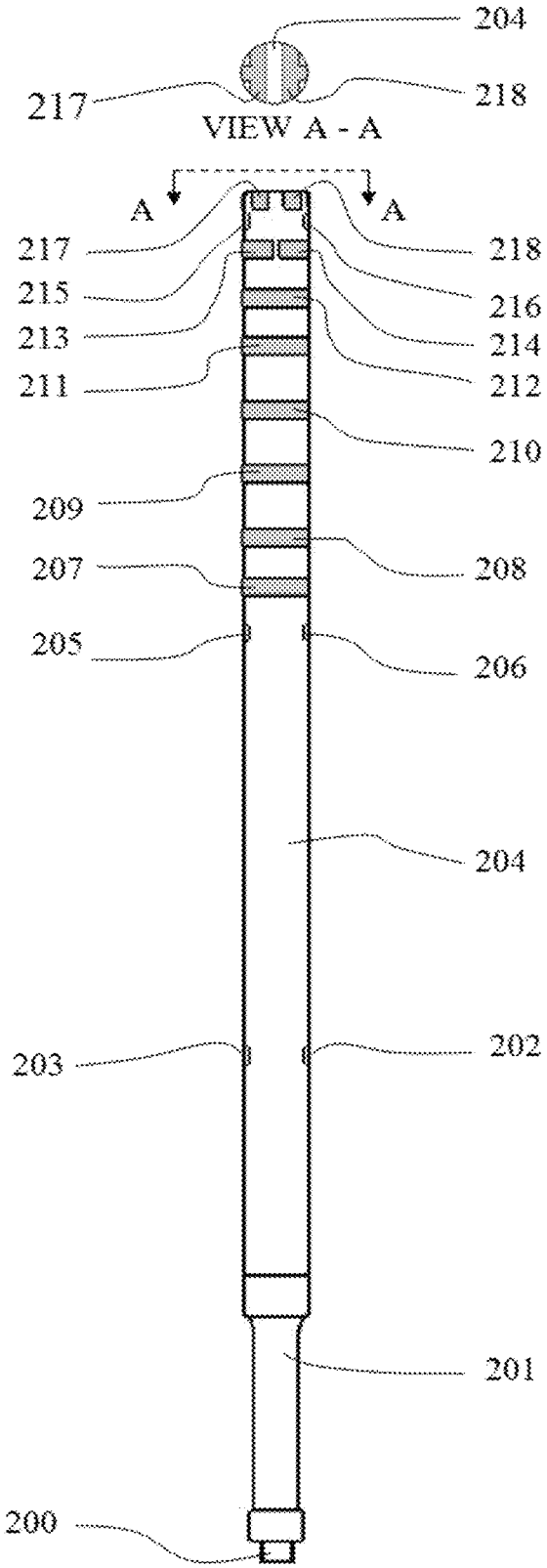
FIG. 2 illustrates the nonmetallic sword provided with electric touch sensors, according to the preferred embodiment of the invention.

FIG. 2 illustrates the preferred embodiment of a nonmetallic sword 107. According to the invention, the nonmetallic sword 107 comprising:

a known electrical plug 200;

a plastic handle 201;

a blade 204, which in the preferred embodiment is made of foam;

a plurality of touch sensors 207, 208, 209, 210, 211, 212, 213, 214, 217, and 218, which in the preferred embodiment are made of known electrically conductive fabric;

and a plurality of known lighting devices 202, 203, 205, 206, 215 and 216, which are incorporated inside the blade 204 such that to be visible from the outside of the blade 204.

In VIEW A of FIG. 2 is illustrated the tip of the blade 204. In the preferred embodiment, the blade 204 is cylindrical, and the tip is flat. On the tip of the blade 204 is placed a plurality of touch sensors 217 and 218, which are electrically isolated between each other. In another embodiment the tip of the blade can be round-shaped.

In another embodiment the sword can also have a guard around the handle, to protect the fingers which are gripping the handle. In other embodiments, on the blade 204 can be added more sensors than shown in FIG. 2.

In other embodiments, the touch sensors 207, 208, 209, 210, 211, 212, 213, 214, 217, and 218 can be made of either one or a mix of following materials:

electrically conductive plastic;

electrically conductive rubber;

electrically conductive foam;

and electrically conductive carbon.

In another embodiment of the invention, the sword 107 can be constructed without the lighting devices 202, 203, 205, 206, 215, and 216.

During the play of the swordplay game, the objective of each player is to touch with his/her sword, the opponent player. The purpose of this invention is to use an electric circuit to detect the touches during the swordplay game. This feature is supported by the current invention by the electric circuit incorporated inside the mobile touch detector apparatus 112, which is monitoring the touch sensors 207, 208, 209, 210, 211, 212, 213, 214, 217, and 218 placed on the blade 204 of the sword 107.

In the current description of the invention and in the claims, the term "fencing touch" refers to the action where one player touches either the jacket 109 or the mask 106 of the opponent player, with at least two adjacent touch sensors out of the touch sensors 207, 208, 209, 210, 211, 212, 213, 214, 217, 218 from the blade 204 of his/her sword 107. For example when in current invention description, it is stated that "player 180 executed a fencing touch", it means that player 180 touched with his/her sword 107 either the jacket 109 or the mask 106 of player 190, such that at least two adjacent touch sensors out of 207, 208, 209, 210, 211, 212, 213, 214, 217, 218 from the blade 204 of sword 107 held by player 180 are in electrical contact with either the jacket 109 or the mask 106 worn by player 190.

According to the invention, the occurrences of said fencing touches executed by one player are captured by the mobile touch detector apparatus 112 carried by the player, and encoded in data packets which are transmitted through radio 111 to the radio 104 incorporated inside the scoreboard controller apparatus 103. Furthermore, the scoreboard controller apparatus 103 assigns scoring points based on the scoring rules preprogrammed in PCM 105, and then updates accordingly, the score digits on the scoreboard display apparatus 101. When the score reaches to a predefined maximum value, the player with the biggest score is declared the winner of the swordplay bout.

Figure 3:
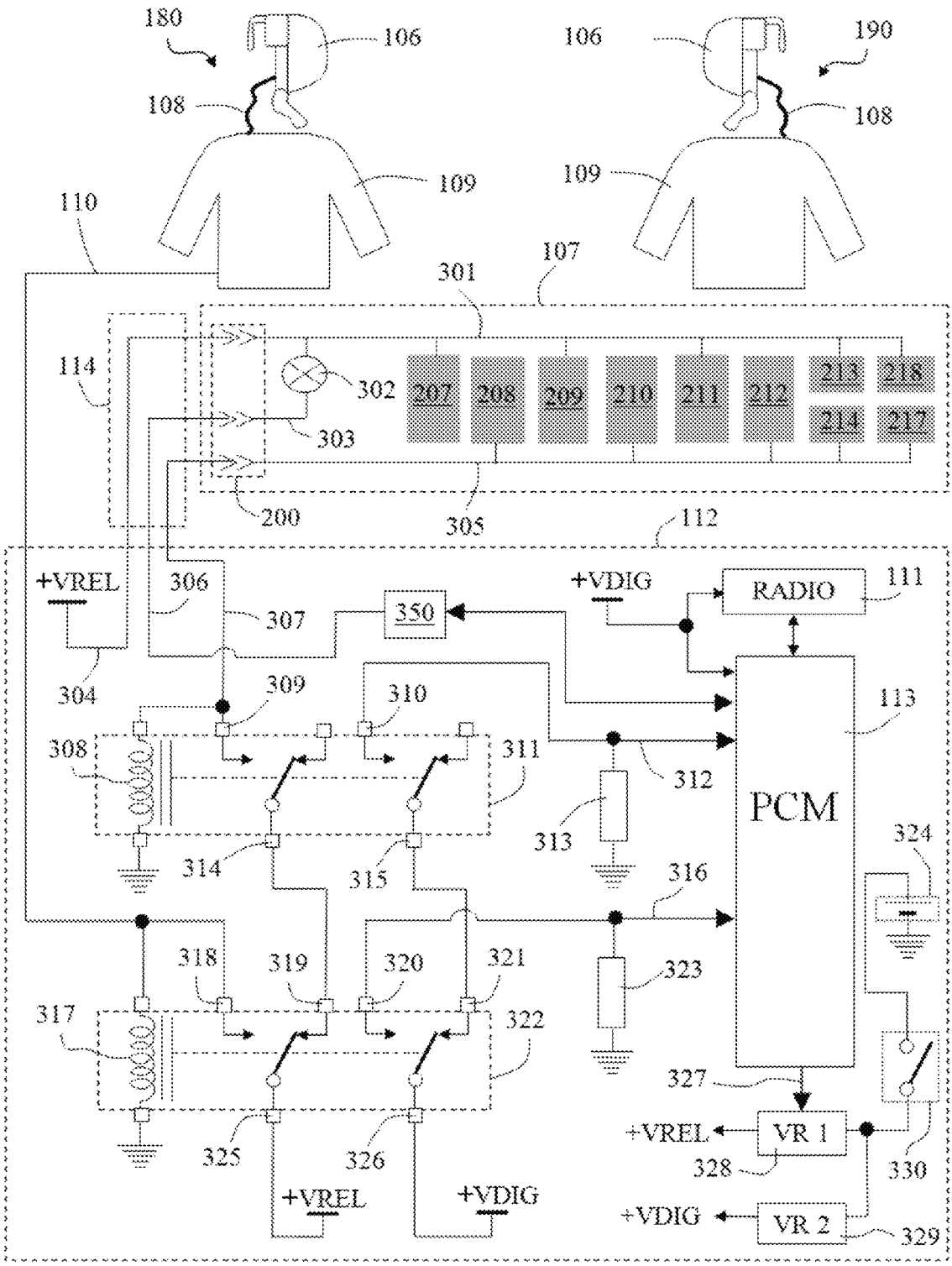
FIG. 3 shows the electric circuit of the touch detector apparatus, and how this circuit is connected with the sword, the jacket and the mask, according to the invention.

FIG. 3 shows the circuit incorporated inside the mobile touch detector apparatus 112 and how this circuit is electrically connected with the touch sensors 207, 208, 209, 210, 211, 212, 213, 214, 217, and 218, from the sword 107 of the player who carries the mobile touch detector apparatus 112. Furthermore, FIG. 3 also shows how the circuit incorporated inside the mobile touch detector apparatus 112 is electrically connected with the jacket 109 of the player who carries the mobile touch detector apparatus 112.

FIG. 3 illustrates the preferred embodiment of the electrical wiring inside the sword 107, the electrical circuit inside the sword 107 comprising:

an electrical wire 301, which is electrically connected with the touch sensors 207, 209, 211, 213, and 218;

an electrical wire 305, which is electrically connected with the touch sensors 208, 210, 212, 214, and 217;

a known electrical lighting device 302, which provides the source of light for the lighting devices 202, 203, 205, 206, 215, 216;

and an electrical plug 200, which connects the wires 301, 303, and 305 with the electrical cable 114.

The cable 114 makes the electrical connection between the sword 107 and the mobile touch detector apparatus 112, furthermore the cable 114 comprising the electrical wires 304, 306, and 307.

The electrical wire 110 connects the jacket 109 to the electrical circuit incorporated inside the mobile touch detector apparatus 112.

The electrical lighting device 302 is connected to electrical wire 303, and through the plug 200 is connected to the electrical driver circuit 350. The circuit 350 is controlled by the PCM 113, in order to change the color of the light emitted by the lighting devices 202, 203, 205, 206, 215, 216, as described herein.

In the preferred embodiment, the circuit 350 is also used to detect when the cable 114 is plugged into the plug 200 of the sword 107. Furthermore the plug-state of the cable 114 is transmitted by PCM 113 through radio 111, to the scoreboard controller apparatus 103, which uses the signs 152 and 155 to indicate whether the swords 107 are plugged properly into the system.

The circuit incorporated inside the mobile touch detector apparatus 112, uses battery 324 as power source for the two known voltage regulators 328 and 329, which generate the voltages VREL and VDIG, respectively. The voltage VDIG is used to power the radio module 111 and the PCM 113. The voltage VREL is used to power the two known relays 322 and 311. The voltage VDIG stays at nominal value as long as the switch 330 is closed. The voltage VREL can be powered down by the PCM 113, by disabling the voltage regulator 328 through the wire 327.

The two relays 322 and 311 are double pole double throw type.

The internal contact of relay 311 between terminals 309 and 314 is normally opened. The internal contact of relay 311 between terminals 310 and 315 is normally opened. The internal contact of relay 322 between terminals 318 and 325 is normally opened. The internal contact of relay 322 between terminals 320 and 326 is normally opened.

As part of the invention, when a player touches with his/her sword 107 the metallic surface of either one of the jackets 109 or one of the masks 106, an electric contact is created between at least one of the sensors connected to wire 301, and one of the sensors connected to wire 305.

The contact is created because the metallic surface of either the jacket 109 or the mask 106 creates an electrically conductive bridge between the sensors 207, 209, 211, 213, 218, and at least one of the sensors 208, 210, 212, 214, 217.

As part of the invention, when a player touches with his/her sword 107, either the jacket 109 of the opponent player or the mask 106 of the opponent player, then inside his/her own touch detector 112, the voltage VREL propagates from wire 304, through plug 200, then through wire 301, then through touch sensors 207, 209, 211, 213, 218, then through the metallic surface of jacket 109 or mask 106 of the opponent player, then through at least one of the touch sensors 208, 210, 212, 214, 217, then through wire 305, then through plug 200, then through wire 307, reaching this way to power up the coil 308 of relay 311.

According to the invention, the function of relay 311 is to detect when one player touches with his/her sword 107, either the jacket 109 or the mask 106 of the opponent player.

The electrical wire 307 represents the input of the mobile touch detector apparatus 112, because the voltage VREL propagates through this wire when the player who carries the mobile touch detector apparatus 112, executes a fencing touch as described herein.

As part of the invention, when a player touches with his/her sword 107, his/her own jacket 109, the voltage VREL propagates from wire 304, through plug 200, then through wire 301, then through the touch sensors 207, 209, 211, 213, 218, then through the metallic surface of jacket 109, then through electrical wire 110, this way powering up the coil 317 of relay 322.

As part of the invention, when a player touches with his/her sword 107, his/her own mask 106, the voltage VREL propagates from wire 304, through plug 200, then through wire 301, then through touch sensors 207, 209, 211, 213, 218, then through the metallic source of mask 106, then through electrical wire 108, then through jacket 109, then through electrical wire 110, this way powering up the coil 317 of relay 322.

According to the invention, the function of relay 322 is to detect when a player touches with his/her sword 107, either his/her own jacket 109 or his/her own mask 106.

Figure 4:
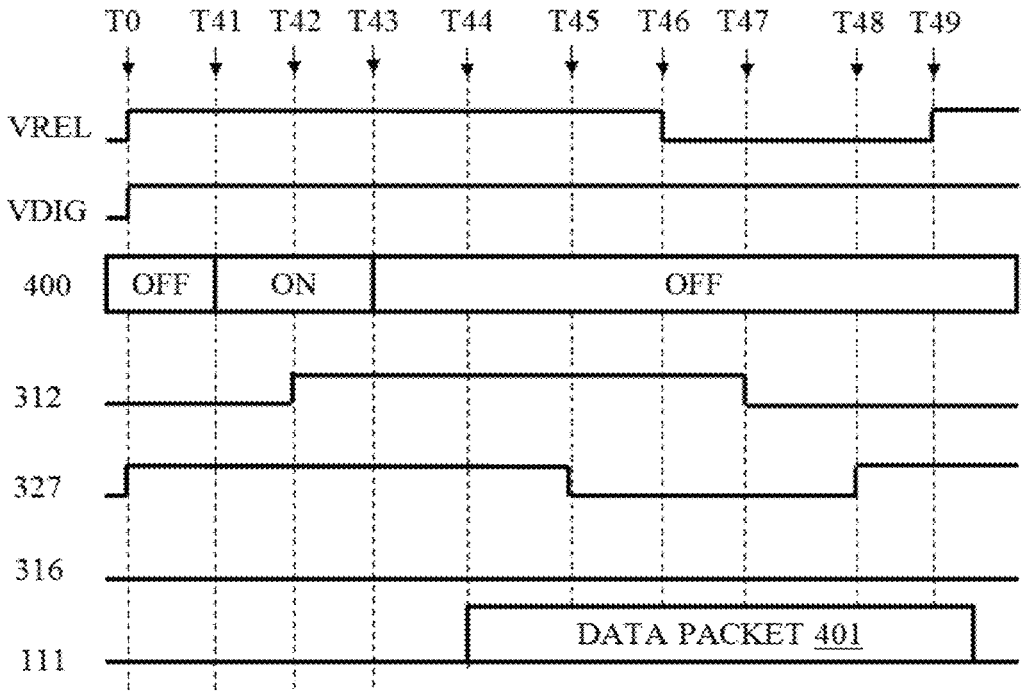
FIG. 4 shows a timing diagram with the waveforms of the signals from the circuit incorporated inside the touch detector apparatus, when a player touches with his/her sword, either the jacket or mask of the opponent player.

FIG. 4 shows a timing diagram with the waveforms of the signals from the circuit incorporated inside the mobile touch detector apparatus 112 when the player who carries the mobile touch detector apparatus 112 executes a fencing touch as described herein.

Figure 5:
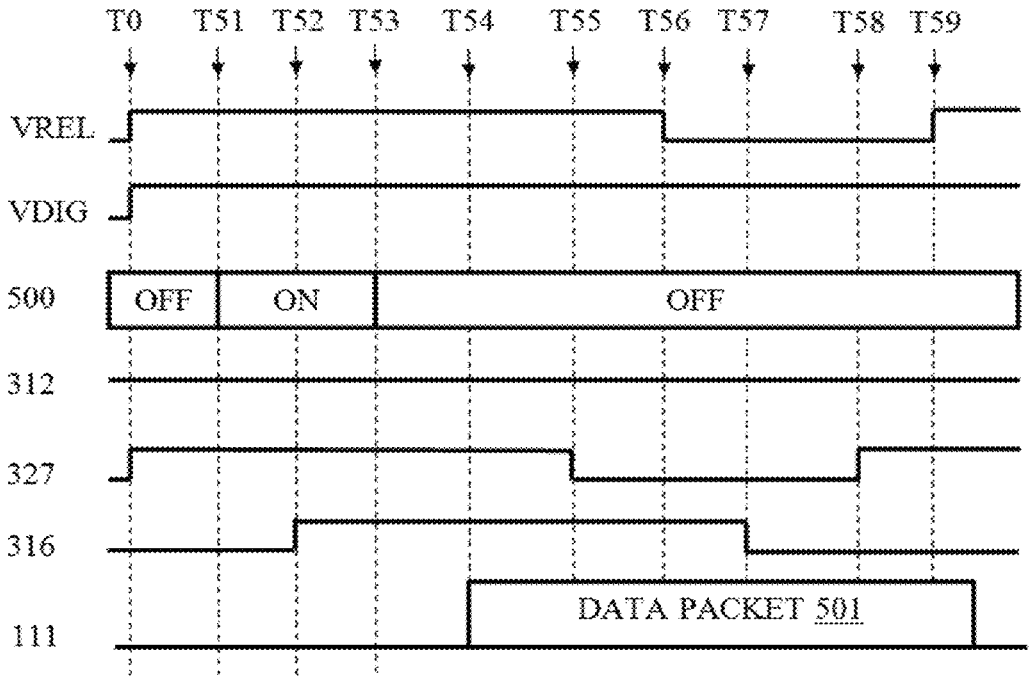
FIG. 5 shows a timing diagram with the waveforms of the signals from the circuit incorporated inside the touch detector apparatus, when a player touches his/her own jacket or mask, with his/her own sword.

FIG. 5 shows a timing diagram with the waveforms of the signals from the circuit incorporated inside the mobile touch detector apparatus 112, when the player who carries the mobile touch detector apparatus 112 touches with his/her sword 107 either his/her own jacket 109 or his/her own mask 106.

At time T0, in FIG. 4 and FIG. 5, the touch detector 112 is turned on manually by operating the switch 330, allowing this way to propagate the voltage from battery 324, to the voltage regulators 328 and 329.

In FIG. 4, the time T41 is the moment when the player who carries the mobile touch detector apparatus 112 executes a fencing touch as described herein. At time T41, at least two adjacent touch sensors out of 207, 208, 209, 210, 211, 212, 213, 214, 217, 218, from the sword 107 of the player who carries the mobile touch detector apparatus 112, are in electrical contact with either the jacket 109 or the mask 106 of the opponent player. Furthermore, the contact starts at time T41 and lasts until time T43.

The waveform 400 represents the contact between the touch sensors from the sword of a player and either the jacket or the mask of the opponent player. The waveform 400 is marked "ON" when the touch sensors from a sword of a player are in contact with the jacket or the mask of the opponent player, which is between times T41 and T43. The waveform 400 is marked "OFF" when the sword is not touching any jacket or any mask.

For example if the player 190 executes a fencing touch, then at time T41, at least two adjacent touch sensors out of 207, 208, 209, 210, 211, 212, 213, 214, 217, 218 from the sword 107 of player 190, are in electrical contact with either the jacket 109 or the mask 106 of the player 180. Furthermore, the touch sensors stay in contact with either the jacket or the mask until time T43.

The relay 311 detects when a player touches with his/her sword, either the jacket or the mask of the opponent player, as described herein.

Thus, at time T41 the voltage VREL propagates to the coil 308, as described herein.

Powering up the coil 308 causes the internal contact of relay 311 between terminals 314 and 309, to close.

The voltage VREL is propagated to terminal 314, through internal contact of relay 322, between terminals 325 and 319.

When the coil 308 is powered at time T41, the voltage VREL propagates from terminal 314 to terminal 309, reaching to coil 308, and bringing the relay 311 in a self-locking state. Thus, the coil 308 stays powered up after time T43. The relay 311 can exit the self-locking state only if the voltage VREL is powered down.

The voltage VDIG is propagated to terminal 315, through internal contact of relay 322, between terminals 326 and 321. Powering up the coil 308 causes the internal contact of relay 311 between terminals 315 and 310, to close. This causes to propagate the voltage VDIG from terminal 315 to terminal 310, reaching to PCM 113 through wire 312. At time T0, the voltage level on wire 312 is zero volts, because of the pull-down resistor 313. But after coil 308 is powered up at time T41, the voltage level of wire 312 becomes at time T42, equal with voltage VDIG.

According to the invention, the voltage level of wire 312 is a distinctive state of the touch detector circuit, and the electrical state of wire 312 represents that the player who carries the mobile touch detector apparatus 112 executed a fencing touch. Once the voltage level of wire 312 becomes equal with the voltage VDIG, it is stored to the same voltage level until the relay 311 is reset by dropping the voltage VREL to zero volts.

After time T42, the PCM 113 detects that voltage level of wire 312 has changed from zero volts to the level of VDIG voltage. According to the invention, PCM 113 is programmed to generate data packets 401 when it detects that the voltage level of wire 312 has changed from zero volts to same level as VDIG voltage.

As shown in FIG. 4, at time T44 the PCM 113 starts to transmit the data packet 401 through radio 111. According to the invention, inside the data packet 401, there is encoded information about which player touched with his/her sword 107, either the jacket 109 or the mask 106 of the opponent player.

After PCM 113 starts to transmit the data packet 401 at time T44, then at time T45 the PCM 113 disables the voltage regulator 328, through wire 327. This causes the voltage VREL to drop to zero volts at time T46, causing the relay 311 to reset. Furthermore the internal contact of relay 311 between terminals 315 and 310 opens, causing the voltage level on wire 312 to drop to zero volts, at time T47.

After time T47, the PCM 113 detects that the voltage level of wire 312 has changed from the level of VDIG voltage to zero volts, and enables again the voltage regulator 328 at time T48. This causes the voltage VREL to go back to nominal value at time T49. Furthermore, after time T49 the mobile touch detector apparatus 112 to is ready to detect the next fencing touch in the swordplay bout.

In FIG. 5, the time T51 is the moment when the player who carries the mobile touch detector apparatus 112, touches with his/her sword 107, either his/her own jacket 109 or his/her own mask 106. At time T51, at least two adjacent touch sensors out of 207, 208, 209, 210, 211, 212, 213, 214, 217, 218, from the sword 107 of the player who carries the mobile touch detector apparatus 112, are in electrical contact with either his/her own jacket 109 or his/her own mask 106. Furthermore, the contact starts at time T51, and lasts until time T53.

The waveform 500 represents the contact between the touch sensors from the sword of a player and either his/her own jacket or his/her own mask. The waveform 500 is marked "ON" when the touch sensors from the sword of a player are in contact with either his/her own jacket or his/her own mask, which is between times T51 and T53. The waveform 500 is marked "OFF", when the sword is not touching any jacket or any mask.

The relay 322 detects when a player touches with his/her sword, either his/her own jacket or mask, as described herein. Thus, at time T51 the voltage VREL propagates to the coil 317, as described herein.

Powering up the coil 317 causes the internal contact of relay 322 between terminals 325 and 318, to close. Furthermore the voltage VREL propagates from terminal 325 to terminal 318, reaching to coil 317, and bringing the relay 322 in a self-locking state. Thus, the coil 317 stays powered up after time T53. The relay 322 can exit the self-locking state only if the voltage VREL is powered down.

When coil 317 is powered, the voltages VREL and VDIG are blocked from propagating to terminals 314 and 315, respectively, because the normally closed contacts of relay 322, are opened when coil 317 is powered. When coil 317 is powered, the voltage VDIG does not propagate to terminal 321 of relay 322, because the internal contact between terminals 326 and 321 is opened.

As shown in FIG. 3, the two relays 311 and 322 are connected together such that when a player touches his/her own jacket or mask, with his/her own sword, the voltage level of wire 312 will stay zero volts, as shown in FIG. 5.

Furthermore, the PCM 113 cannot transmit data packets 401 when the player who carries the mobile touch detector apparatus 112 touches with his/her sword either his/her own jacket or mask, because the voltage level of wire 312 stays zero volts. Moreover, due to the connection between the relays 311 and 322, a player will never receive a scoring point when touches his/her own jacket or mask with his/her own sword.

Powering up the coil 317 causes the internal contact of relay 322 between terminals 326 and 320, to close. This causes to propagate the voltage VDIG to terminal 320, reaching to PCM 113 through wire 316. At time T0, the voltage level on wire 316 is zero volts, because of the pull-down resistor 323. But after coil 317 is powered up at time T51, the voltage level of wire 316 becomes at time T52, equal with voltage VDIG.

According to the invention, the voltage level of wire 316 is a distinctive state of the touch detector circuit, and the electrical state of wire 316 represents that the player who carries the mobile touch detector apparatus 112 touched with his/her sword, either his/her own jacket or mask.

Once the voltage level of wire 316 becomes equal with the voltage VDIG, it is stored to the same voltage level until the relay 322 is reset by dropping the voltage VREL to zero volts.

After time T52, the PCM 113 detects that voltage level of wire 316 has changed from zero volts to the level of VDIG voltage. According to the invention, PCM 113 is programmed to generate data packets 501 when it detects that the voltage level of wire 316 has changed from zero volts to same level as VDIG voltage.

As shown in FIG. 5, at time T54 the PCM 113 starts to transmit the data packet 501 through radio 111. According to the invention, inside the data packet 501, there is encoded information about which player touched with his/her sword 107, either his/her own jacket 109 or his/her own mask 106.

After PCM 113 starts to transmit the data packet 501 at time T54, then at time T55 the PCM 113 disables the voltage regulator 328, through wire 327. This causes the voltage VREL to drop to zero volts at time T56, causing the relay 322 to reset. Furthermore the internal contact of relay 322 between terminals 326 and 320 opens, causing the voltage level on wire 316 to drop to zero volts, at time T57.

After time T57, the PCM 113 detects that the voltage level of wire 316 has changed from the level of VDIG voltage to zero volts, and enables again the voltage regulator 328 at time T58. This causes the voltage VREL to go back to nominal value at time T59. Furthermore, after time T59 the mobile touch detector apparatus 112 to is ready to detect the next fencing touch in the bout.

When a player executes a fencing touch, the wire 316 stays at zero volts, as shown in FIG. 4, because the coil 317 of relay 322 is powered only when the touch sensors from the sword of a player touch either his/her own jacket or mask, as described herein.

An object of the current invention is to provide an efficient system of touch sensors capable to detect any fencing touches. FIG. 6 illustrates the shape of the touch sensors 207, 208, 209, 210, 211, 212, 213, 214, 217, and 218, in the preferred embodiment.

Figures 6A, 6B:
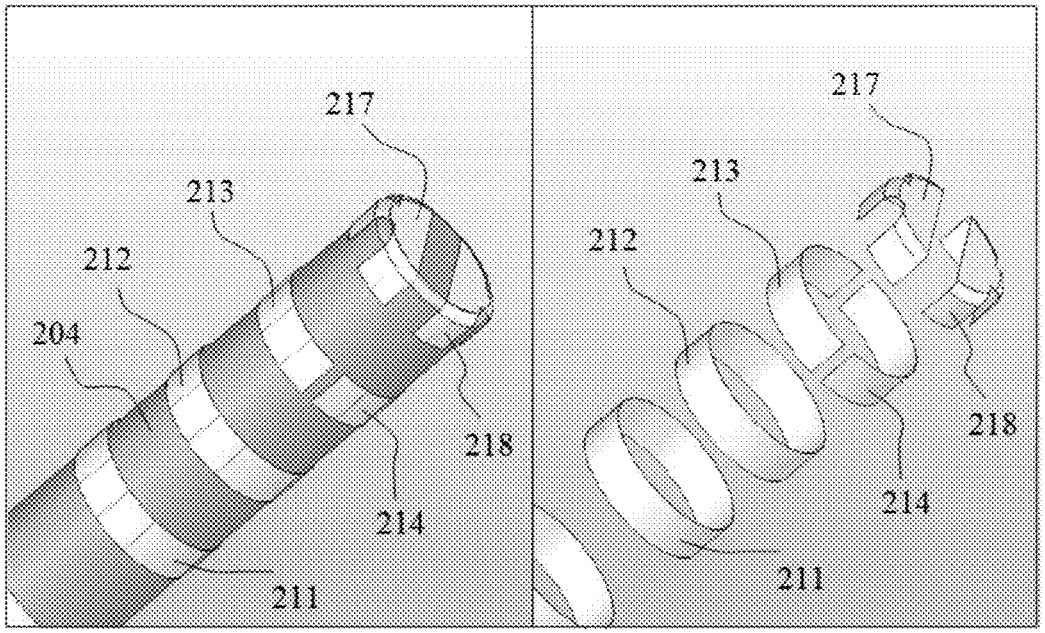
FIG. 6A is a three dimensional view of the tip of the sword, showing the touch sensors on the blade.
FIG. 6B is a three dimensional view showing the touch sensors without the blade.

In FIG. 6A is shown a three dimensional view of the blade 204. In FIG. 6B the sensors are shown without the blade, in order to illustrate the shape of the touch sensors.

As part of the invention, the touch sensors 217 and 218 are placed on the tip of the blade 204. When a player touches with the tip of his/her sword 107, either the jacket 109 or the mask 106 of the opponent player, then the metallic surface of either the jacket or the mask, creates an electric contact between the sensors 217 and 218.

In other embodiments, in order to increase the chances of detecting a fencing touch, on the tip of the blade can be placed a plurality of touch sensors, which can be shaped as circle segments.

As part of the invention, the touch sensors 213 and 214 are shaped as two ring segments of equal sizes. As shown in FIG. 3, the touch sensors 213 and 218 are connected to the wire 301, and the touch sensors 214 and 217 are connected to the wire 305. Thus, during a fencing touch, the metallic surface of either the jacket 109 or the mask 106 can be detected if it creates an electrical contact between 213 and 217, or between 213 and 214, or between 214 and 218, or between 218 and 217.

In FIG. 6, the touch sensors 212 and 211 are shaped as rings.

In the preferred embodiment the touch sensors 207, 208, 209, 210, 211, and 212 are shaped as rings, and any two adjacent rings are connected to another wire inside the blade 204, as shown in FIG. 3. Thus, during a fencing touch, the metallic surface of either the jacket 109 or the mask 106 can be detected if it creates an electrical contact between 212 and 211, or between 211 and 210, or between 210 and 209, or between 209 and 208, or between 208 and 207.

In other embodiments the touch sensors can be a plurality of ring segments, and each touch sensor connected to a different wire inside the blade of the sword.

In other embodiments the touch sensors can mix between a plurality of rings and a plurality of ring segments, and each touch sensor connected to a different wire inside the blade of the sword.

In traditional fencing sport the referee applies complex rules when assigns scoring points to the players during the bout. According to the invention, a scoring method is programmed in the PCM 105, such that the scoring points are decided by the scoreboard controller apparatus 103, thus eliminating the need of a referee in the swordplay game.

Figure 7:
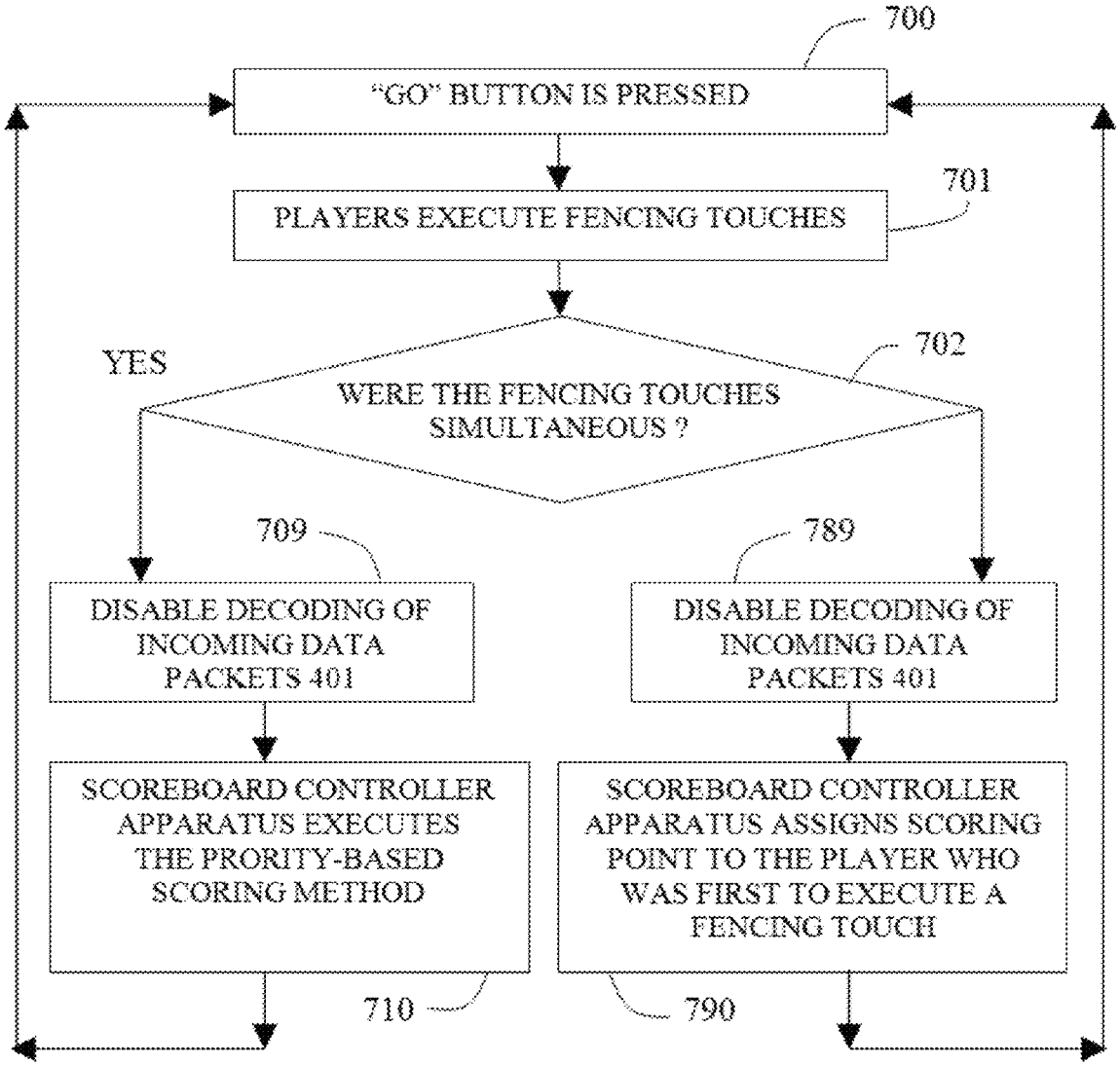
FIG. 7 shows the diagram of the scoring method implemented in the state machine of the scoreboard controller apparatus.

FIG. 7 shows the diagram of the scoring method implemented in the state machine programmed in the PCM 105.

In state 700 the "GO" button 117 is pressed, and then the two players start a round of swordplay. After the "GO" button 117 is pressed, the PCM 105 enables the decoding of any incoming data packet 401, and then the scoreboard controller apparatus 103 moves to state 701.

When players execute fencing touches, the PCM 113 incorporated in the mobile touch detector apparatuses 112 generate data packets 401, which are transmitted through the radios 111, as described herein. According to the invention, in state 701, the PCM 105 waits for the data packets 401 to be received.

After the PCM 105 receives data packets 401 through radio 104, the scoreboard controller apparatus 103, moves to state 702.

According to the invention, in state 702 the PCM 105 checks if the two players executed fencing touches simultaneously.

If the PCM 105 determines in state 702, that in state 701 the players did not execute fencing touches simultaneously, then the scoreboard controller apparatus 103 moves to state 789.

According to the invention, in state 789 the PCM 105 disables the decoding of any incoming data packets 401, and then the scoreboard controller apparatus 103 moves to state 790.

According to the invention, in state 790, the PCM 105 assigns a scoring point to the player who was first to execute the fencing touch in state 701, and the score is then incremented accordingly on the scoreboard display apparatus 101, for the player was first to execute the fencing touch.

If the PCM 105 determines in state 702, that in state 701 the two players did execute fencing touches simultaneously, then the scoreboard controller apparatus 103 moves to state 709.

According to the invention, in state 709 the PCM 105 disables the decoding of any incoming data packets 401, and then the PCM 105 applies the priority-based scoring method 710.

According to the invention, the priority-based scoring method 710 is applied when the two players execute fencing touches simultaneously.

Figure 8:
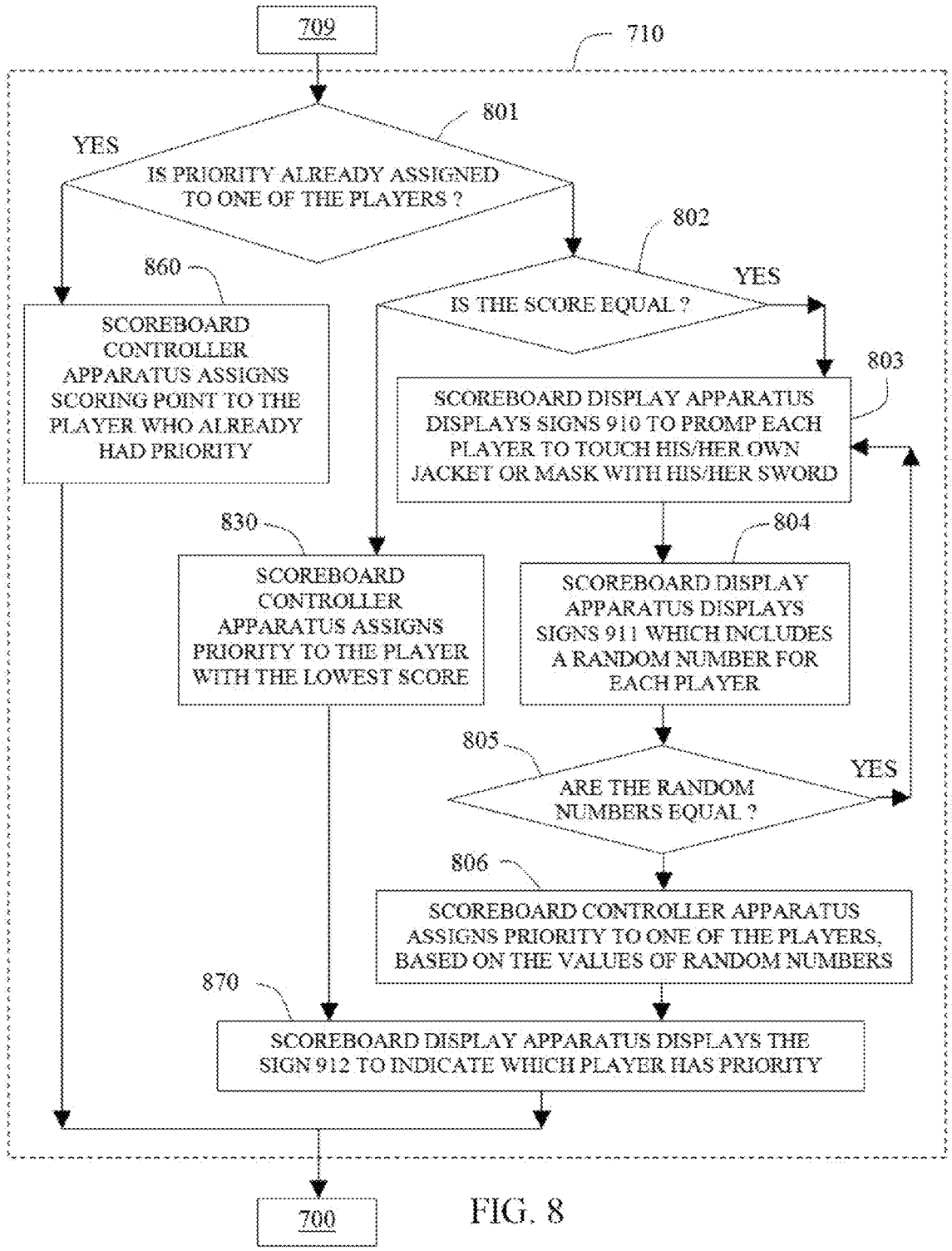
FIG. 8 shows the diagram of the priority-based scoring method according with the preferred embodiment of the invention.

In FIG. 8 is shown the diagram of the state machine programmed in PCM 105, which applies scoring rules according to the preferred embodiment of the priority-based scoring method 710.

As shown in FIG. 8, from state 709 the scoreboard controller apparatus 103 moves to state 801 which is the first state of the priority-based scoring method 710.

The priority-based scoring method 710, comprising:

a method of assigning priority;

a method of using the priority after is assigned;

and a method to indicate which player has priority.

A method of assigning priority is supported in the state machine from FIG. 8, by the sequence of the states 802, 803, 804, 805, 806, and 830.

A method of using the priority after is assigned, is supported in the state machine from FIG. 8, by the sequence of the states 801 and 860.

A method to indicate which player has priority is supported in the state machine from FIG. 8 by the state 870.

According to the invention, in state 801 the PCM 105 checks if priority is already assigned to one of the two players.

If one of the players already had priority in the moment when the scoreboard controller apparatus 103 entered the state 801, then the scoreboard controller apparatus 103 moves to state 860.

According to the invention, in state 860, the scoreboard controller apparatus 103 assigns a score point to the player who already had priority in the moment when the scoreboard controller apparatus 103 entered the state 801. The score digits are updated on the scoreboard display apparatus 101, such that to have an incremented value for the player who won the scoring point in state 860.

If none of the two players had priority already assigned when scoreboard controller 103 entered the state 801, then the scoreboard controller 103 moves to state 802.

According to the invention, in state 802 the PCM 105 checks if the score is equal.

If in state 802 the PCM 105 determines that score is not equal then the scoreboard controller 103 moves to state 830.

According to the invention, in state 830 the scoreboard controller apparatus 103 assigns priority to the player with the lowest score.

If in state 802 the PCM 105 determines that score is equal then the scoreboard controller 103 moves to state 803.

Figure 9A:
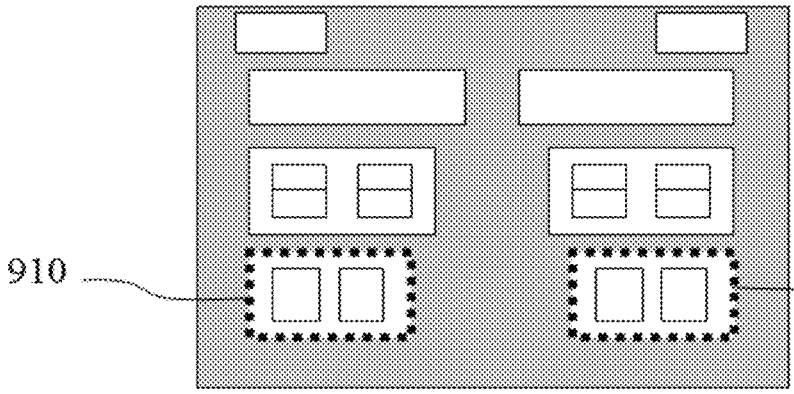
FIG. 9A illustrates a distinctive sign displayed on the scoreboard apparatus, to prompt each player to touch with his/her sword either his/her own jacket or mask.

According to invention, when the scoreboard controller apparatus 103 is in state 803 the scoreboard display apparatus 101 displays a distinctive sign 910 for each player, as shown in FIG. 9A.

In the preferred embodiment, by displaying the sign 910, the priority-based scoring method 710 prompts the players 180 and 190 to take part in the process of assigning the priority.

In the preferred embodiment, the sign 910 is a rectangle with a two digit number inside, and the number is "00". Furthermore, the rectangle from the sign 910 has a dashed border line, wherein the border line is blinking in order to attract visual attention to the players.

In the preferred embodiment, the scoreboard controller apparatus 103 is programmed to stay in the state 803 until receives data packets 501 from each of the mobile touch detector apparatuses 112 carried by the players 180 and 190.

As described herein, the PCM 113 incorporated inside the mobile touch detector apparatus 112 transmits data packets 501 when the player who carries the mobile touch detector apparatus 112, touches with the touch sensors from his/her sword 107, either his/her own jacket 109 or mask 106.

As part of the invention, when the prompt sign 910 is displayed for each player on the scoreboard display apparatus 101, the scoreboard controller apparatus 103 expects for each of the players, 180 and 190, to touch their own jackets 109 or masks 106, with the touch sensors from their own swords 107.

After the data packets 501 are received by the PCM 105, from each mobile touch detector apparatus 112, the scoreboard controller apparatus 103 moves to state 804.

According to the invention, the data packets 501 are ignored by PCM 105, unless the scoreboard controller 103 is in state 803.

Figure 9B:
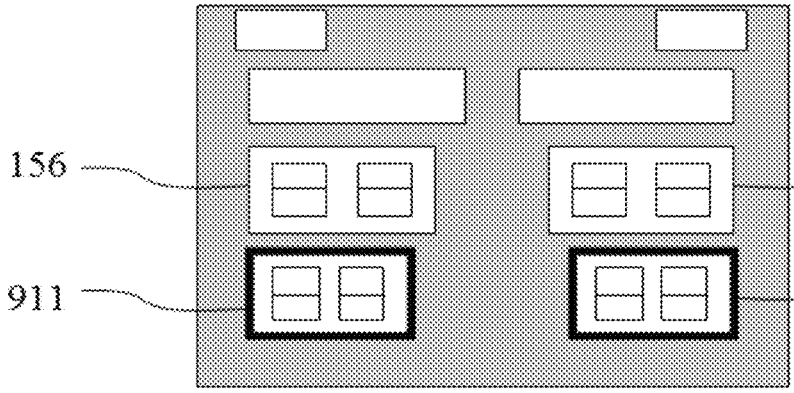
FIG. 9B illustrates a distinctive sign displayed on the scoreboard apparatus, to indicate the random numbers used by the priority-based scoring method.

According to the invention, when the scoreboard controller apparatus 103 is in state 804, the scoreboard display apparatus 101 displays a distinctive sign 911 for each player, as shown in FIG. 9B.

In the preferred embodiment, the sign 911 is a rectangle with a two digit number inside, and the number has a random value between 1 and 99. Furthermore, the rectangle from the sign 911 has a solid border line.

In the preferred embodiment, the scoreboard controller apparatus 103 generates one random number for each player, immediately after the data packet 501 is received from the mobile touch detector apparatus 112 carried by the player.

As shown in FIG. 9B, in the preferred embodiment, the random number generated for player 180 is displayed inside the sign 911 placed below the score number 156, and the random number generated for player 190 is displayed inside the sign 911 placed below the score number 157.

According to the invention, after a random number is generated for each player, the scoreboard controller apparatus 103 moves to state 805, where the two random numbers are compared by PCM 105. If in state 805, the PCM 105 determines that the two random numbers are equal, then the scoreboard controller apparatus 103 returns to state 803, in order to generate another set of random numbers by executing again the states 804 and 805.

As shown in FIG. 8, the states 803, 804 and 805 are executed in a loop, until the numbers generated inside the signs 911 are not equal.

If in state 805, the PCM 105 determines that the two random numbers displayed inside the signs 911, are not equal, then the scoreboard controller apparatus 103 moves to state 806 where the priority is assigned to one of the players, based on the values of the random numbers.

In the preferred embodiment, in state 806 the priority is assigned to the player who has the biggest random number displayed inside the sign 911.

Furthermore, in the preferred embodiment, the scoreboard apparatus controller 103 is provided with hardware peripherals 102, such as a keypad, which can configure the scoreboard controller apparatus 103 before the bout starts. The keypad from peripherals 102 can configure scoreboard controller apparatus 103 to choose whether in state 806, the priority is assigned either to the player who has the biggest number or the smallest number.

According to the invention, after the priority is assigned to one of the players, either in state 830 or in state 806, the scoreboard controller apparatus 103 moves to state 870.

In the preferred embodiment, when the scoreboard controller apparatus 103 is in state 870, on the scoreboard display apparatus 101 is displayed a distinctive sign 912, to indicate which player has priority.

Figure 9C:
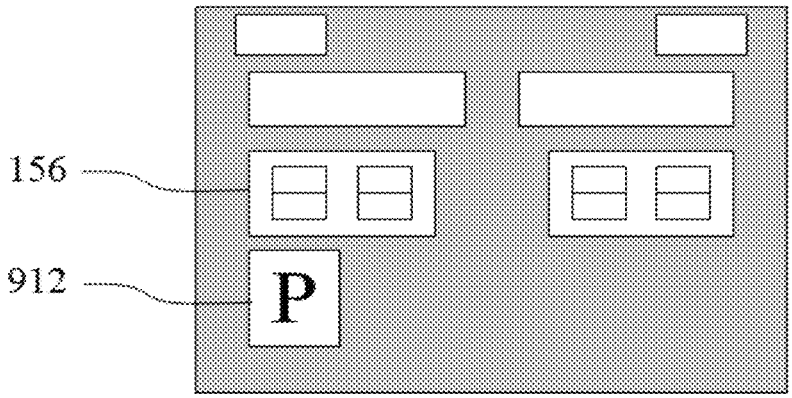
FIG. 9C and FIG. 9D illustrate a distinctive sign displayed on the scoreboard apparatus, to indicate which of the players has priority.
Figure 9D:
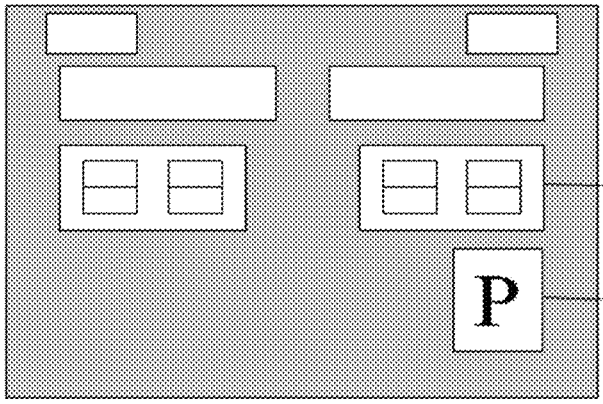

When the priority is assigned to the player 180 the sign 912 is displayed below the score number 156 as shown in FIG. 9C and when the priority is assigned to the player 190 the sign 912 is displayed below the score number 157 as shown in FIG. 9D.

According to the invention, when the scoreboard controller apparatus 103 applies the priority-based scoring method 710, either player can receive priority, but only one player can have priority at one time.

In the preferred embodiment, the sign 912 is a letter "P" inside of a rectangle with a solid border line.

According to the invention, the score does not change when the scoreboard controller apparatus 103 executes the states 802, 803, 804, 805, 806, 830, and 870.

According to the invention, after completing the priority-based scoring method 710, the scoreboard controller apparatus 103 returns to state 700, where PCM 105 waits for the "GO" button 117 to be pressed when the next round of swordplay begins.

According to the invention, any time when the "STOP" button 118 is pressed, the scoreboard controller apparatus 103 returns to state 700.

In the preferred embodiment, when the "GO" button 117 is pressed, the players are informed that the round of swordplay is started, by the following visual signals:

the background of the image 151 is set to a predefined color;

the lighting devices 202, 203, 205, 206, 215 and 216 emit light of a predefined color;

and the wrist collar apparatus 121 emits a light of a predefined color.

In the preferred embodiment, when the "STOP" button 118 is pressed, the players are informed that the round of swordplay is stopped, by the following visual signals:

the signs 153 and 154 are set to a predefined color;

the background of the image 151 is set to a predefined color;

the lighting devices 202, 203, 205, 206, 215 and 216 emit light of a predefined color;

and the wrist collar apparatus 121 emits a light of a predefined color.

In the preferred embodiment, after a player wins a scoring point, the players are informed that the round of swordplay is stopped, by the following visual signals:

the signs 153 and 154 are set to predefined colors, such that to distinguish which player is the winner of the scoring point, and which player executed the fencing touch second;

the background of the image 151 is set to a predefined color;

and the lighting devices 202, 203, 205, 206, 215 and 216 emit light of predefined colors, such that to distinguish which player is the winner of the scoring point, and which player executed the fencing touch second.

For example a green rectangle signifies "the player was first to execute a fencing touch" and a blue rectangle signifies "the player was second to execute fencing touch". Then if both players execute fencing touches, but player 180 was faster than player 190, then on the scoreboard display apparatus, the sign 153 will be a blinking green rectangle and the sign 154 will be a blinking blue rectangle. Furthermore, in this particular example the player 180 receives a scoring point because in state 790 is detected that he/she was first to execute a fencing touch, so in this case the green rectangle also signifies that the player 180 won the scoring point.

In the preferred embodiment, after PCM 105 determined in state 702 that the players executed simultaneous fencing touches, the players are informed that the fencing touches were executed simultaneously, by the following visual signals:

the signs 153 and 154 are set to the same predefined color;

and the lighting devices 202, 203, 205, 206, 215 and 216 emit light of the same predefined color from both sword.

In the preferred embodiment the priority assigned to one of the players is cancelled on the first occurrence when a scoring point was obtained by either player, in either state 860 or 790. When the priority is canceled, the sign 912 is removed from the frame of the scoreboard display apparatus 101.

Furthermore, in the preferred embodiment, the keypad from peripherals 102 can configure the scoreboard controller apparatus 103 before the bout starts, in order to choose whether the priority cancelation is allowed only when score points are assigned in state 860, after the players execute fencing touches simultaneously.

Figure 10:
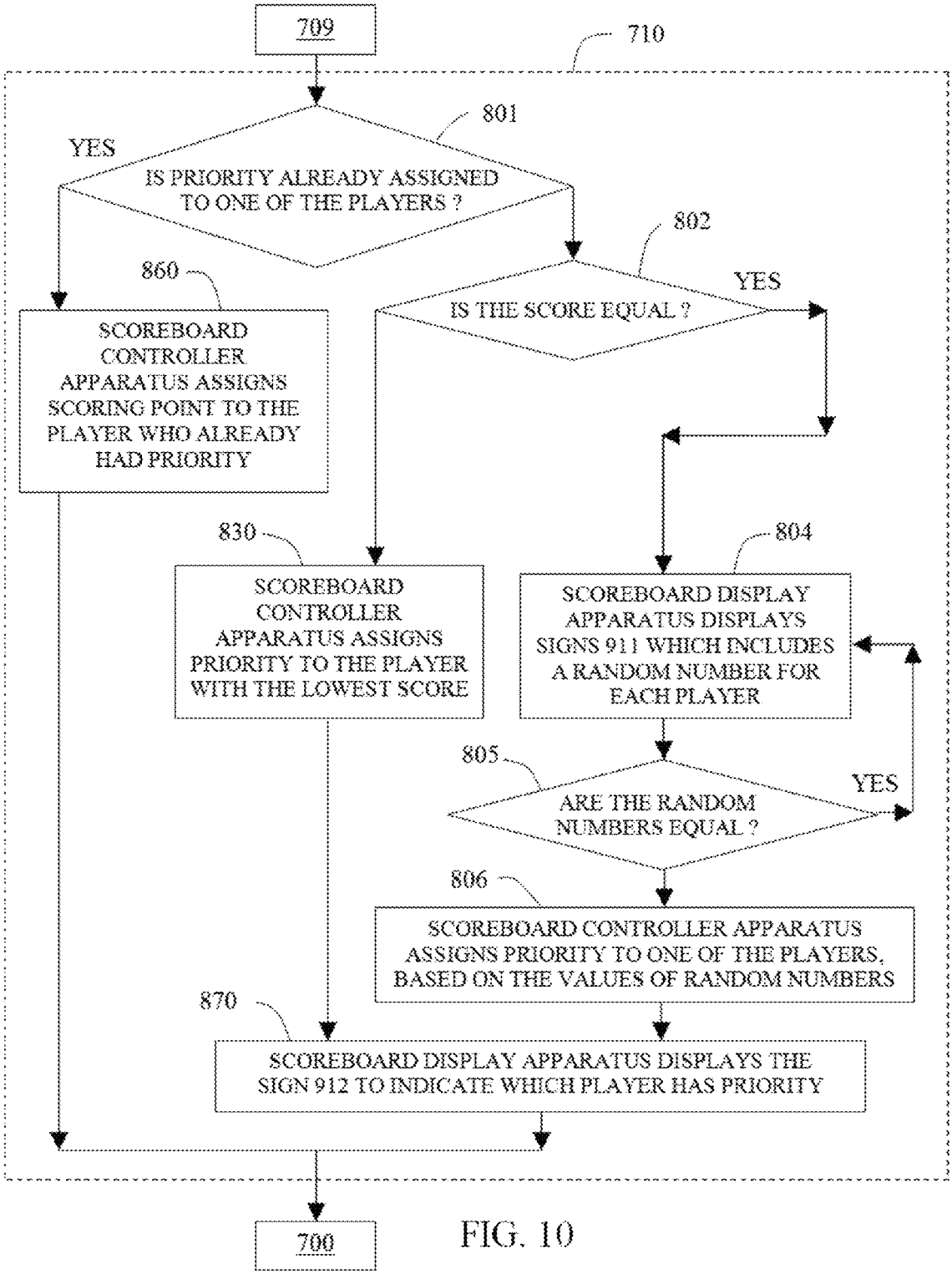
FIG. 10 shows the diagram of an alternative implementation of the priority-based scoring method wherein one state is removed.

FIG. 10 is a block diagram of another embodiment of the priority-based scoring method 710, wherein the state 803 is removed.

In the embodiment of the priority-based scoring method 710 shown in FIG. 10, the players are not prompted to touch either their own jacket or mask with their own swords. Thus, the random numbers displayed inside the sign 911 are generated by the scoreboard controller apparatus 103 right after the PCM 105 determines that score is equal in state 802.

Figure 11:
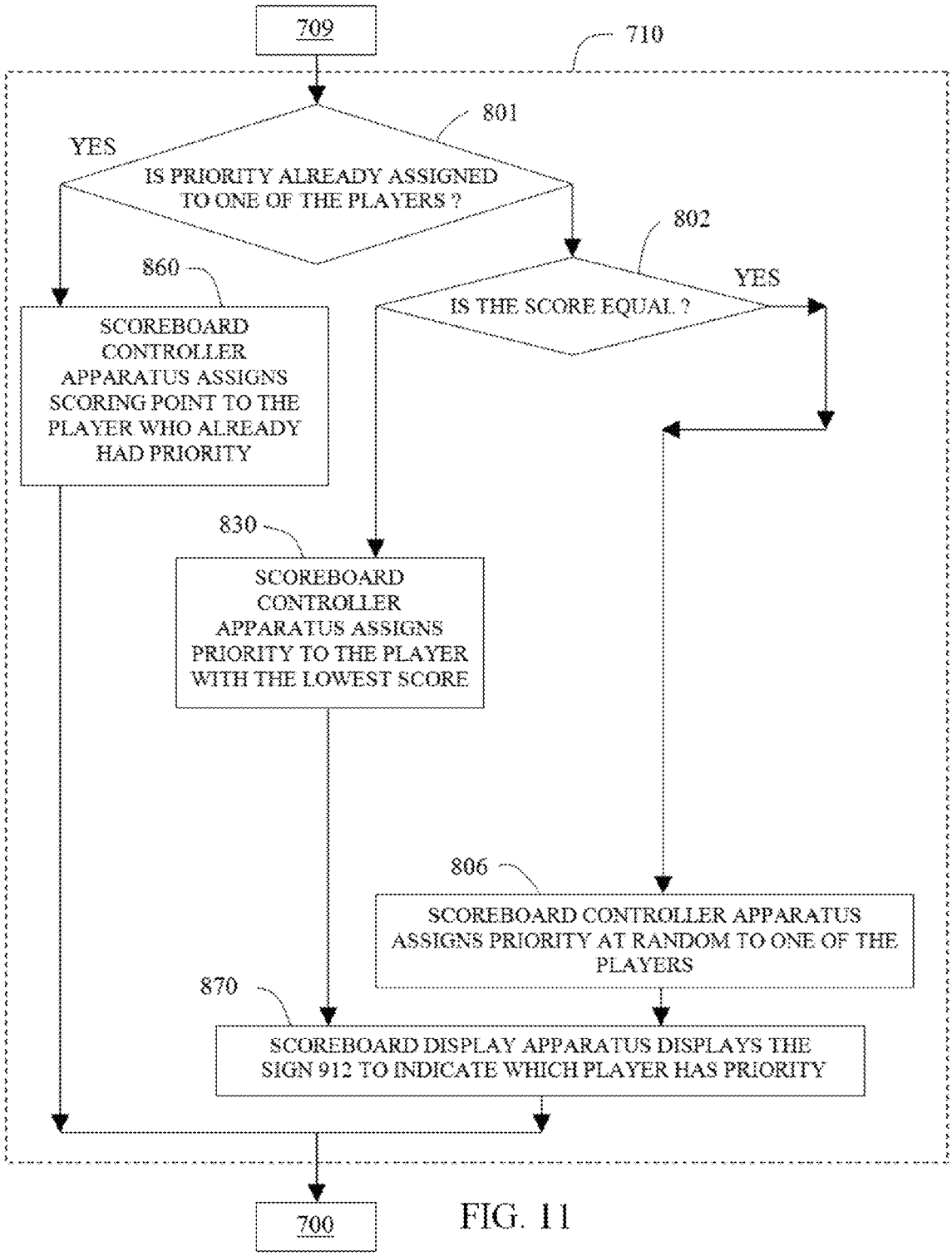
FIG. 11 shows the diagram of an alternative implementation of the priority-based scoring method wherein three states are removed.

FIG. 11 is a block diagram of another embodiment of the priority-based scoring method 710, wherein the states 803, 804, and 805 are removed. Furthermore, in the embodiment of the priority-based scoring method 710 shown in FIG. 11, in state 806 the scoreboard controller apparatus 103 assigns priority at random, to one of the players.

Although the invention has been described in connection with a preferred embodiment, it should be understood that various modifications, additions and alterations may be made to the invention by one skilled in the art without departing from the spirit and scope of the invention as defined in the appended claims.

What I claim is:

1. A wireless scoring system for a swordplay game comprising at least two players, said system comprising:

a sword used by each of said players, wherein said sword comprises a handle, a blade made of nonmetallic materials, and a system of touch sensors positioned around the periphery of said blade;

a fencing jacket worn by each of said players, wherein said fencing jacket is made with electrically conductive threads;

a fencing mask worn by each of said players, wherein the external surface of said fencing mask is electrically conductive;

a scoreboard apparatus configured to display score and specific signs used in said swordplay game;

a scoreboard controller apparatus electrically associated with said scoreboard apparatus, wherein said scoreboard controller apparatus comprises a first radio network apparatus and a first programmable controller apparatus configured to: (a) process data packets received through said first radio network apparatus, (b) control scoring rules, (c) record said score, and (d) control the images displayed on said scoreboard apparatus; and a mobile touch detector apparatus carried by each of said players, wherein said mobile touch detector apparatus comprises:

(a) a second radio network apparatus configured to communicate with said first radio network apparatus;

(b) a first touch detector electric circuit electrically associated with said system of touch sensors from said sword, wherein said first touch detector electric circuit is configured to generate a first touch detection signal when the player who carries said mobile touch detector apparatus executed a fencing touch by touching with his/her said sword at least one of (i) said fencing jacket of an opponent player and (ii) said fencing mask of said opponent player, wherein said fencing touch includes at least one touch sensor of the system of touch sensors on said blade of said sword touching said opponent player;

(c) a second touch detector electric circuit electrically associated with said fencing jacket and said fencing mask and said system of touch sensors from said sword, wherein said second touch detector electric circuit is configured to generate a second touch detection signal when the player who carries said mobile touch detector apparatus executed a self-touch by touching with his/her said sword at least one of (i) his/her own said fencing jacket and (ii) his/her own said fencing mask, wherein said self-touch includes at least one touch sensor of the system of touch sensors on said blade of said sword touching his/her own fencing jack or fencing mask; and (d) a second programmable controller apparatus configured to transmit data packets through said second radio network apparatus when triggered by at least one of (i) said first touch detection signal and (ii) said second touch detection signal.

2. The wireless scoring system of claim 1, wherein:

(a) said mobile touch detector apparatus further comprises a plug detection electric circuit configured to generate a plug-state signal when an electrical cable is connected between said mobile touch detector apparatus and said sword;

(b) said second programmable controller apparatus is further configured to transmit a sword plug information data packet to said first programmable controller apparatus, when triggered by said plug-state signal; and (c) said first programmable controller apparatus is further configured to display on said scoreboard apparatus the plug status of each said sword comprised in said wireless scoring system, upon decoding all said sword plug information data packets received from all said second programmable controller apparatuses comprised in said wireless scoring system.

3. The wireless scoring system of claim 1, wherein said mobile touch detector apparatus further comprises an audible signaling device electrically associated with said first touch detector electric circuit, wherein said audible signaling device is configured to generate an audio signal indicator when triggered by said first touch detection signal.

4. The wireless scoring system of claim 1, wherein:

(a) said second programmable controller apparatus is further configured to transmit a temporal information data packet to said first programmable controller apparatus, wherein said temporal information data packet contains information about the time when said first touch detection signal was generated upon said fencing touch was executed; and (b) said first programmable controller apparatus is further configured to determine when two of said players executed said fencing touches simultaneously, upon decoding all said temporal information data packets received from all said second programmable controller apparatuses comprised in said wireless scoring system.

5. The wireless scoring system of claim 4, wherein said first programmable controller apparatus is further configured to determine the player who was first to execute said fencing touch and the player who was second to execute said fencing touch, upon decoding all said temporal information data packets received from all said second programmable controller apparatuses comprised in said wireless scoring system.

6. The wireless scoring system of claim 5, wherein said wireless scoring system further comprises a remote control apparatus to control said first programmable controller apparatus, wherein said remote control apparatus comprises:

a start button to enable said first programmable controller apparatus; and a stop button to disable said first programmable controller apparatus.

7. The wireless scoring system of claim 6, wherein said wireless scoring system further comprises a wrist collar apparatus electrically associated with said remote control apparatus, wherein said wrist collar apparatus comprises:

a wrist collar;

a plurality of light emitting devices incorporated inside said wrist collar, such that the light emitted by said plurality of light emitting devices is configured to generate a light indicator when triggered by at least one of (a) said start button and (b) said stop button.

8. The wireless scoring system of claim 4, wherein said wireless scoring system further comprises a remote control apparatus to control said first programmable controller apparatus, wherein said remote control apparatus comprises:

a start button to enable said first programmable controller apparatus; and a stop button to disable said first programmable controller apparatus.

9. The wireless scoring system of claim 8, wherein said wireless scoring system further comprises a wrist collar apparatus electrically associated with said remote control apparatus, wherein said wrist collar apparatus comprises:

a wrist collar;

a plurality of light emitting devices incorporated inside said wrist collar, such that the light emitted by said plurality of light emitting devices is configured to generate a light indicator when triggered by at least one of (a) said start button and (b) said stop button.

10. The wireless scoring system of claim 1, wherein said wireless scoring system further comprises a remote control apparatus to control said first programmable controller apparatus, wherein said remote control apparatus comprises:

a start button to enable said first programmable controller apparatus; and a stop button to disable said first programmable controller apparatus.

11. The wireless scoring system of claim 10, wherein said wireless scoring system further comprises a wrist collar apparatus electrically associated with said remote control apparatus, wherein said wrist collar apparatus comprises:

a wrist collar;

a plurality of light emitting devices incorporated inside said wrist collar, such that the light emitted by said plurality of light emitting devices is configured to generate a light indicator when triggered by at least one of (a) said start button and (b) said stop button.

12. The wireless scoring system of claim 1, wherein said system of touch sensors comprises a plurality of strips associated with said blade of said sword, wherein said strips are made of materials selected from:

(a) electrically conductive fabric;

(b) electrically conductive carbon;

(c) electrically conductive rubber;

(d) electrically conductive foam; and (e) any combination thereof.

13. The system of claim 12, wherein the shape of said strips is selected from:

(a) linear shaped strips;

(b) zigzag shaped strips;

(c) sinusoidal shaped strips;

(d) ring shaped strips;

(e) ring segment shaped strips; and (f) any combination thereof.

14. The system of claim 13, wherein:

(a) one of any two adjacent touch sensors from said blade of said sword, is connected to a power rail of said first touch detection circuit; and (b) one of any two adjacent touch sensors from the blade of the sword, is connected to an input of said first touch detection circuit.

15. The system of claim 13, wherein:

said sword further comprises a plurality of light emitting devices incorporated inside said blade; and said mobile touch detector apparatus further comprises an electrical driver circuit electrically associated with said first touch detector electric circuit, wherein said electrical driver circuit is configured to control said plurality of light emitting devices incorporated inside said blade of said sword.

16. The system of claim 12, wherein:

(a) one of any two adjacent touch sensors from said blade of said sword, is connected to a power rail of said first touch detection circuit; and (b) one of any two adjacent touch sensors from the blade of the sword, is connected to an input of said first touch detection circuit.

17. The wireless scoring system of claim 1, wherein:

(a) one of any two adjacent touch sensors from said blade of said sword, is connected to a power rail of said first touch detection circuit; and (b) one of any two adjacent touch sensors from the blade of the sword, is connected to an input of said first touch detection circuit.

18. The wireless scoring system of claim 1, wherein said blade of said sword is made of materials selected from:

(a) foam;

(b) plastic;

(c) rubber;

(d) fiberglass; and (e) any combination thereof.

19. The wireless scoring system of claim 1, wherein:

said sword further comprises a plurality of light emitting devices incorporated inside said blade; and said mobile touch detector apparatus further comprises an electrical driver circuit electrically associated with said first touch detector electric circuit, wherein said electrical driver circuit is configured to control said plurality of light emitting devices incorporated inside said blade of said sword.

20. The wireless scoring system of claim 1, wherein said wireless system further comprises:

a computer apparatus, electrically associated with a third radio network apparatus configured to communicate with at least one of (a) said first radio network apparatus and (b) said second radio network apparatus; and a software application running on said computer apparatus, wherein said software application is configured to (a) process data packets received through said third radio network apparatus, (b) control scoring rules, (c) record said score, and (d) control the images displayed on said scoreboard apparatus.

21. A method of scoring in a swordplay game comprising two players wherein each of said two players is equipped with a sword having a handle, a blade made of nonmetallic materials, and a system of touch sensors positioned around the periphery of said blade, a fencing mask that is electrically conductive, and a fencing jacket made with electrically conductive materials, the method comprising the steps of:

using a scoreboard to display specific signs used during said swordplay game and the score of said swordplay game;

using a touch detector apparatus, wherein said touch detector apparatus is configured to detect when a player executed a fencing touch by touching with his/her said sword at least one of (a) said fencing jacket of the opponent player and (b) said fencing mask of said opponent player, wherein said fencing touch includes at least one touch sensor of said system of touch sensors on said blade of said sword touching said opponent player;

using a scoreboard controller apparatus associated with said touch detector apparatus, and configuring said scoreboard controller apparatus to detect (a) the occurrence of each of said two players executing said fencing touch simultaneously, upon said two players executing simultaneously said fencing touch and (b) the player who was first to execute said fencing touch, upon said two players executing consecutively said fencing touches;

using a first touch sign to indicate visually on said scoreboard the player who was first to execute said fencing touch, by displaying said first touch sign in a scoreboard area corresponding to the player who was detected by said scoreboard controller apparatus to be the first to execute said fencing touch;

using a simultaneous-fencing-touches-visual-signal to indicate visually on said scoreboard when said occurrence of simultaneous fencing touches was detected by said scoreboard controller apparatus; and upon at least one of said two players executed at least said fencing touch, applying a first scoring rule by performing one of the steps of:

(a) adding at least one scoring point to one of said two players upon said first touch sign is displayed in the corresponding scoreboard area of one of said two players; and (b) applying a priority-based rule, upon said simultaneous-fencing-touches-visual-signal is displayed on said scoreboard.

22. The method of claim 21, wherein the step of applying a priority-based rule comprises the steps of:

using a first priority sign to indicate visually on said scoreboard that one player has priority;

performing a first check, by checking if said first priority sign was displayed on said scoreboard at the time when said simultaneous-fencing-touches-visual-signal was displayed on said scoreboard; and performing one of the steps of:

(i) when said first priority sign was not displayed on said scoreboard at the time when performing said first check, assigning priority to one of said two players by displaying said first priority sign in the corresponding scoreboard area of one of said two players;

(ii) when said first priority sign was displayed on said scoreboard at the time when performing said first check, assigning at least one scoring point to the player who had said first priority sign displayed in his/her corresponding scoreboard area; and (iii) removing said first priority sign from said scoreboard upon one of preselected events: (a) wining at least one scoring point by one of said two players and (b) wining at least one scoring point by one of said two players upon having said first priority sign displayed in his/her corresponding scoreboard area when said first check was performed.

23. The method of claim 22, wherein the step of assigning priority to one of said two players further comprises:

when said first priority sign was not displayed on said scoreboard at the time when said first check was performed, performing a second check upon said first check was performed, wherein said second check comprises the step of checking said score; and performing one of the steps of:

(a) when said score was not equal when performing said second check, assigning said priority by displaying said first priority sign in the corresponding scoreboard area of the player who had the smaller score points number at the time when said simultaneous-fencing-touches-visual-signal was displayed on said scoreboard; and (b) when said score was equal when performing said second check, applying a priority-based routine.

24. The method of claim 23, wherein said priority-based routine comprises assigning said priority at random to one of said two players by displaying said first priority sign at random in the corresponding scoreboard area of one of said two players.

25. The method of claim 23, wherein said priority-based routine comprises the steps of:

(i) displaying a plurality of random numbers on said scoreboard, such that at least one random number is displayed in the scoreboard area of each player;

(ii) performing a third check by comparing said random numbers and when all said random numbers are equal performing the steps of: (a) removing said plurality of random numbers from said scoreboard, (b) displaying a plurality of random numbers and (c) repeating the step of said third check and the step of displaying a plurality of random numbers until all displayed said random numbers are not equal; and (iii) evaluating preconfigured random number comparison criteria and assigning priority by displaying said first priority sign in the corresponding scoreboard area of one of: (a) the player who had the biggest said random number in his/her corresponding scoreboard area and (b) the player who had the smallest said random number in his/her corresponding scoreboard area.

26. The method of claim 25, wherein the step of assigning priority further comprises:

using a plurality of light emitting devices incorporated in the blade of each said sword, wherein said plurality of light emitting devices is configured to generate a priority light indicator defining a first color that indicates visually that a player has said priority; and generating a light of said first color from said plurality of light emitting devices incorporated in the blade of said sword used by the player who has said first priority sign displayed in his/her corresponding scoreboard area.

27. The method of claim 23, wherein said priority-based routine comprises the steps of:

further configuring said touch detector apparatus to detect when a player touches with his/her said sword at least one of (a) his/her own said fencing jacket and (b) his/her own said fencing mask;

using a second priority sign to prompt visually on said scoreboard that at least one of said two players must touch with his/her said sword at least one of (a) his/her own said fencing jacket and (b) his/her own said fencing mask;

displaying said second priority sign on said scoreboard; and performing the steps of:

(i) displaying a plurality of random numbers on said scoreboard, such that at least one random number is displayed in the scoreboard area of each player, upon said touch detector apparatus detected that each player touched with his/her said sword at least one of (a) his/her own said fencing jacket and (b) his/her own said fencing mask;

(ii) performing a third check by comparing said random numbers and when all said random numbers are equal performing the steps of: (a) removing said plurality of random numbers from said scoreboard, (b) displaying a plurality of random numbers and (c) repeating the step of said third check and the step of displaying a plurality of random numbers until all displayed said random numbers are not equal; and (iii) evaluating preconfigured random number comparison criteria and assigning priority by displaying said first priority sign in the corresponding scoreboard area of one of: (a) the player who had the biggest said random number in his/her corresponding scoreboard area and (b) the player who had the smallest said random number in his/her corresponding scoreboard area.

28. The method of claim 27, wherein the step of assigning priority further comprises:

using a plurality of light emitting devices incorporated in the blade of each said sword, wherein said plurality of light emitting devices is configured to generate a priority light indicator defining a first color that indicates visually that a player has said priority; and generating a light of said first color from said plurality of light emitting devices incorporated in the blade of said sword used by the player who has said first priority sign displayed in his/her corresponding scoreboard area.

29. The method of claim 23, wherein the step of assigning priority further comprises:

using a plurality of light emitting devices incorporated in the blade of each said sword, wherein said plurality of light emitting devices is configured to generate a priority light indicator defining a first color that indicates visually that a player has said priority; and generating a light of said first color from said plurality of light emitting devices incorporated in the blade of said sword used by the player who has said first priority sign displayed in his/her corresponding scoreboard area.

30. The method of claim 22, wherein the step of assigning priority further comprises:

using a plurality of light emitting devices incorporated in the blade of each said sword, wherein said plurality of light emitting devices is configured to generate a priority light indicator defining a first color that indicates visually that a player has said priority; and generating a light of said first color from said plurality of light emitting devices incorporated in the blade of said sword used by the player who has said first priority sign displayed in his/her corresponding scoreboard area.

31. The method of claim 21, wherein said method of scoring further comprises the steps of:

using a remote control apparatus, wherein said remote control apparatus comprises a start button;

using a fight sign to indicate visually on said scoreboard when said scoreboard controller apparatus is enabled; and until said score of said swordplay game reaches a preconfigured maximum value, performing repeatedly the steps of:

(i) starting said swordplay game by actuating said start button to enable said scoreboard controller apparatus;

(ii) displaying said fight sign on said scoreboard upon said start button was actuated;

(iii) applying said first scoring rule, upon at least one of said two players executed at least said fencing touch; and (iv) removing said fight sign from said scoreboard and disabling said scoreboard controller apparatus after one of (a) said first touch sign was displayed on said scoreboard and (b) said simultaneous-fencing-touches-visual-signal was displayed on said scoreboard.

32. The method of claim 31, wherein said method of scoring further comprises the steps of:

using said remote control apparatus, wherein said remote control apparatus further comprises a stop button;

using a fight stop signal to indicate visually on said scoreboard that said swordplay game is stopped; and upon said stop button was actuated, removing said fight sign from said scoreboard and disabling said scoreboard controller apparatus and displaying said fight stop signal on said scoreboard.

33. The method of claim 32, wherein said method of scoring further comprises the steps of:

(a) using a wrist collar;

(b) using a plurality of light emitting devices incorporated in said wrist collar, wherein said plurality of light emitting devices incorporated in said wrist collar is configured to generate at least one of:

(i) a start light indicator defining a third color that indicates visually that said swordplay game is started; and (ii) a stop light indicator defining a fourth color that indicates visually that said swordplay game is stopped;

(c) generating light of said third color from said plurality of light emitting devices incorporated in said wrist collar, upon said start button is actuated; and (d) generating light of said fourth color from said plurality of light emitting devices incorporated in said wrist collar, upon said stop button is actuated.

34. The method of claim 32, wherein said method of scoring further comprises the steps of:

(a) using a plurality of light emitting devices incorporated in each said fencing mask, wherein said plurality of light emitting devices incorporated in each said fencing mask is configured to generate at least one of:

(i) a start light indicator defining a third color that indicates visually that said swordplay game is started; and (ii) a stop light indicator defining a fourth color that indicates visually that said swordplay game is stopped;

(b) generating light of said third color from said plurality of light emitting devices incorporated in each said fencing mask, upon said start button is actuated; and (c) generating light of said fourth color from said plurality of light emitting devices incorporated in each said fencing mask, upon said stop button is actuated.

35. The method of claim 31, wherein said method of scoring further comprises the steps of:

further configuring a plurality of light emitting devices incorporated in the blade of each said sword, to generate a fight light indicator defining a second color that indicates visually that said scoreboard controller apparatus is enabled; and generating a light of said second color from said plurality of light emitting devices incorporated in the blade of each said sword when said fight sign is displayed on said scoreboard.

36. The method of claim 31, wherein said method of scoring further comprises the steps of:

using a wrist collar;

using a plurality of light emitting devices incorporated in said wrist collar, wherein said plurality of light emitting devices incorporated in said wrist collar is configured to generate a start light indicator defining a third color that indicates visually that said swordplay game is started; and generating light of said third color from said plurality of light emitting devices incorporated in said wrist collar, upon said start button is actuated.

37. The method of claim 31, wherein said method of scoring further comprises the steps of:

using a plurality of light emitting devices incorporated in each said fencing mask, wherein said plurality of light emitting devices incorporated in each said fencing mask is configured to generate a start light indicator defining a third color that indicates visually that said swordplay game is started; and generating light of said third color from said plurality of light emitting devices incorporated in each said fencing mask, upon said start button is actuated.

38. The method of claim 21, wherein said method of scoring further comprises:

using a plurality of light emitting devices incorporated in the blade of each said sword, wherein said plurality of light emitting devices is configured to generate a wining light indicator defining a fifth color that indicates visually that a player won at least one scoring point; and generating light of said fifth color from said plurality of light emitting devices incorporated in the blade of the sword of one player, when said one player wins at least one scoring point.

39. The method of claim 21, wherein said method of scoring further comprises:

using a plurality of light emitting devices incorporated in said fencing mask of each of said two players and in said fencing jacket of each of said two players, wherein said plurality of light emitting devices is configured to generate a wining light indicator defining a sixth color that indicates visually that a player won at least one scoring point; and generating light of said sixth color from said plurality of light emitting devices incorporated in said fencing mask and in said fencing jacket of one player, when said one player wins at least one scoring point.

* * * * *

UNITED STATES PATENT AND TRADEMARK OFFICE

CERTIFICATE OF CORRECTION

PATENT NO. : 8,876,613 B2
APPLICATION NO. : 13/651370
DATED : November 4, 2014
INVENTOR(S) : Gheorghe Florea It is certified that error appears in the above-identified patent and that said Letters Patent is hereby corrected as shown below:

In the Claims

Column 16, Lines 5-9, Claim 1(c)(ii) please change the word “jack” to “jacket”.

Signed and Sealed this
Seventeenth Day of April, 2018

Andrei Iancu

Andrei Iancu
*Director of the United States Patent and Trademark Office*